United States Patent [19]

Shadwick

[11] Patent Number: 4,462,068

[45] Date of Patent: Jul. 24, 1984

[54] LUMINAIRE WITH IMPROVED LENS STRUCTURE

[75] Inventor: Jan Shadwick, Newark, Ohio

[73] Assignee: Manville Service Corporation, Denver, Colo.

[21] Appl. No.: 391,666

[22] Filed: Jun. 24, 1982

[51] Int. Cl.[3] ..... F21V 5/00

[52] U.S. Cl. ..... 362/332; 362/309; 362/340; 362/311; 362/329; 362/339; 362/346; 362/375

[58] Field of Search ..... 362/145, 309, 310, 311, 362/328, 329, 332, 339, 341, 346, 375, 340

[56] References Cited

U.S. PATENT DOCUMENTS

| | | | |
|---|---|---|---|
| 3,668,381 | 6/1972 | Schwartz | 362/339 |
| 3,721,818 | 3/1973 | Stahlhut | 362/309 X |
| 4,234,912 | 11/1980 | Barnes et al. | 362/145 |
| 4,285,034 | 8/1981 | Sullivan | 362/350 X |
| 4,368,504 | 1/1983 | Sato et al. | 362/309 X |

FOREIGN PATENT DOCUMENTS

| | | | |
|---|---|---|---|
| 592907 | 2/1960 | Canada | 362/309 |

*Primary Examiner*—Peter A. Nelson
*Attorney, Agent, or Firm*—Ronald M. Halvorsen; Cornelius P. Quinn; Timothy R. Schulte

[57] ABSTRACT

A new and improved luminaire combination is disclosed having a novel lens structure formed with a generally horizontal first lens surface and a generally vertical second lens surface with a generally horizontal flange formed on the second lens surface. The first lens surface is designed to refract a beam of light downwardly and outwardly in a predetermined pattern to form a beam having a cross section approximating the predetermined pattern at a predetermined distance below the lens. The second lens surface is designed to diffuse a beam of light outwardly in a direction perpendicular to the second lens surface.

8 Claims, 17 Drawing Figures

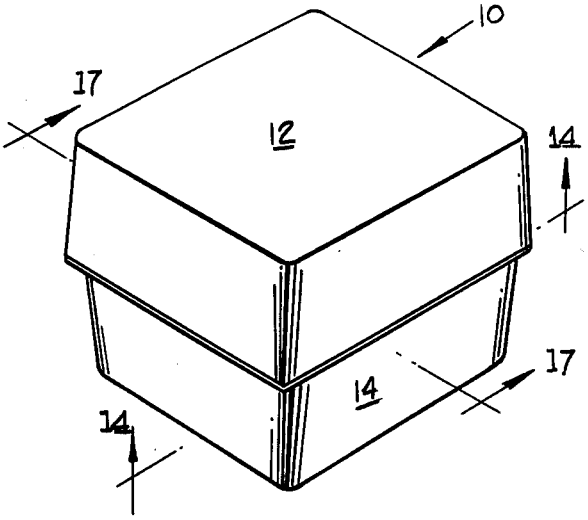
FIG. 1.
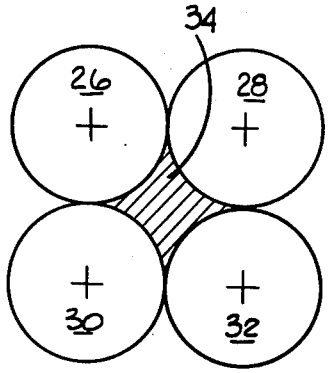
FIG. 2
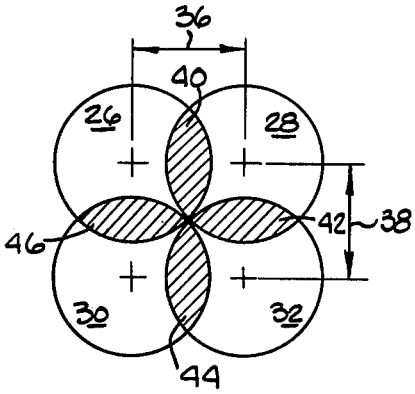
FIG. 3
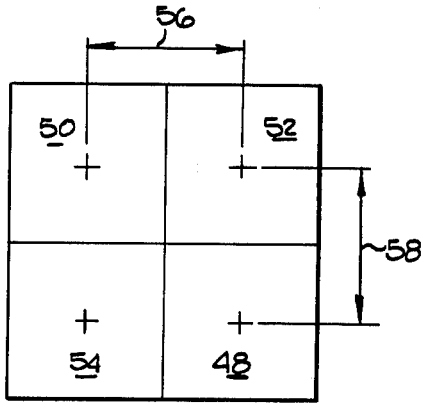
FIG. 4
FIG. 5
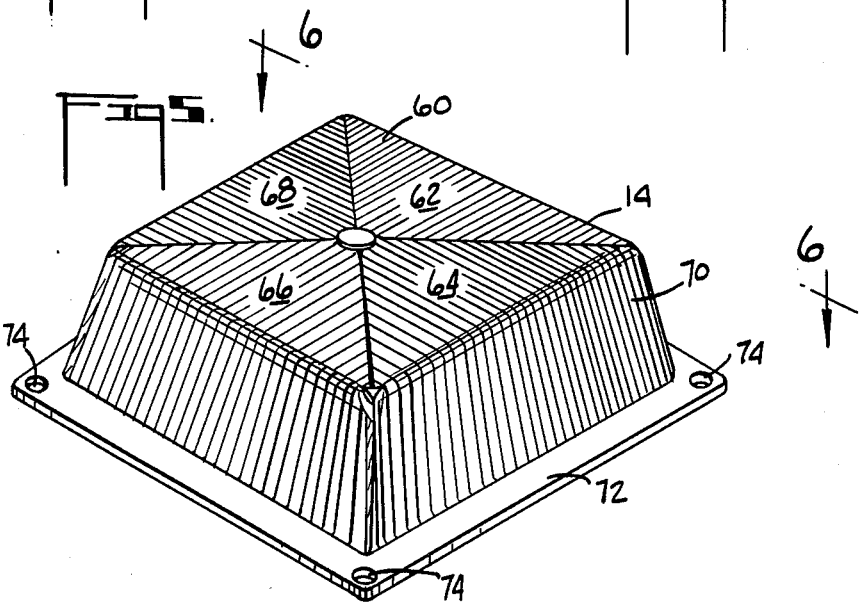

Fig. 9.
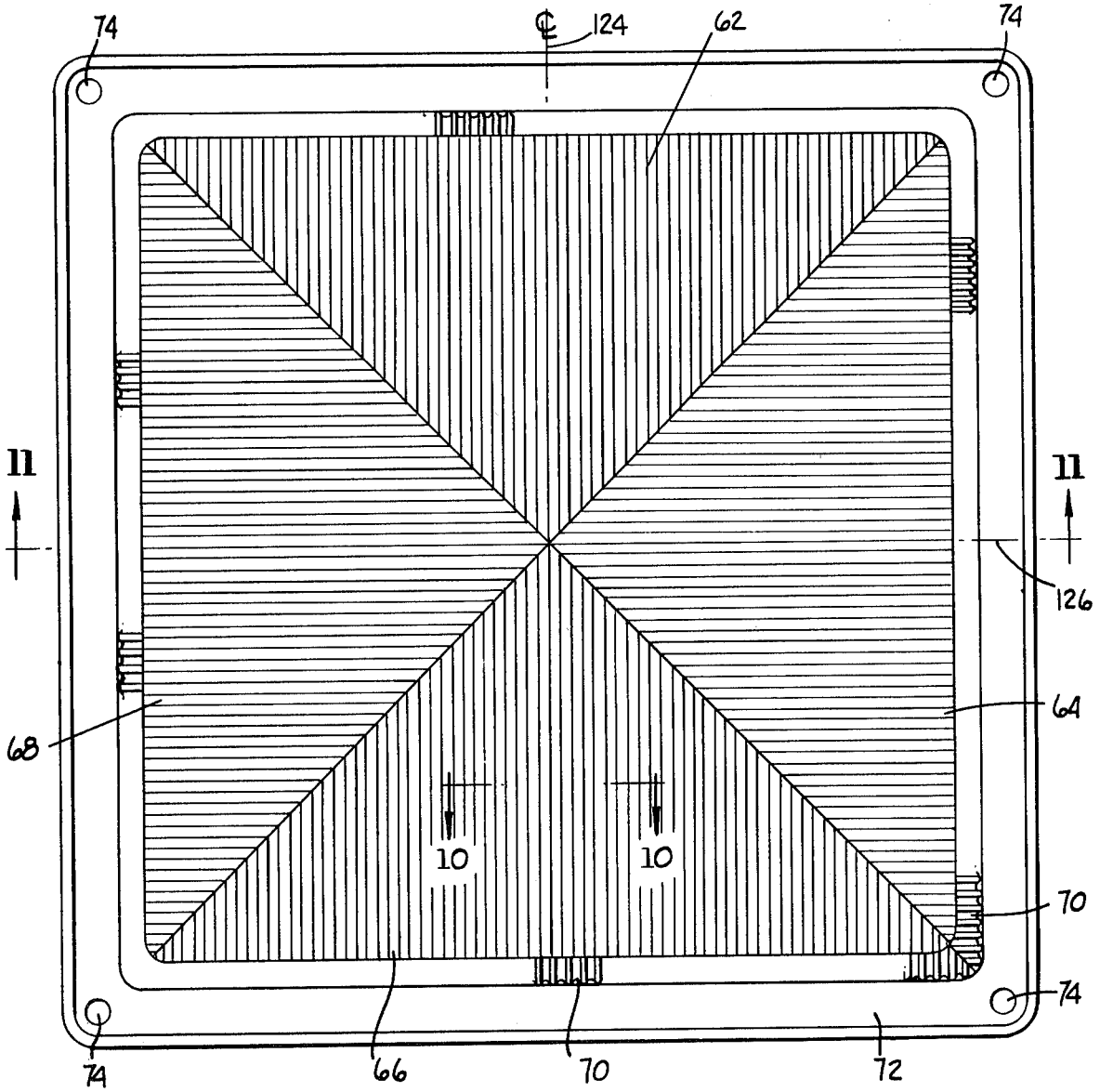
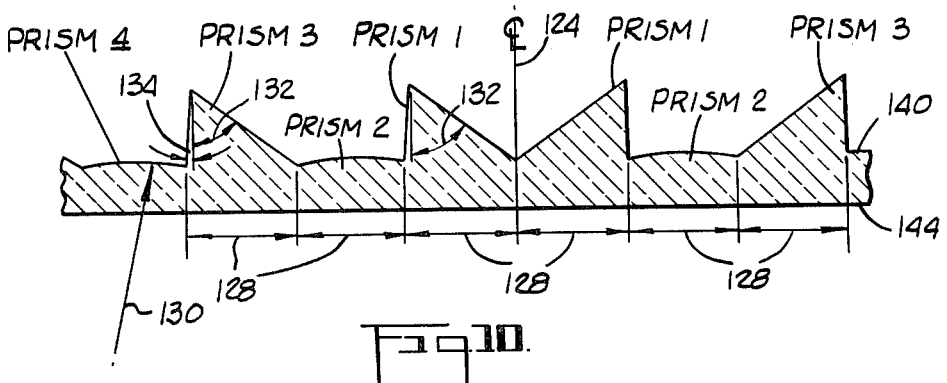
Fig. 10.

Fig. 11.
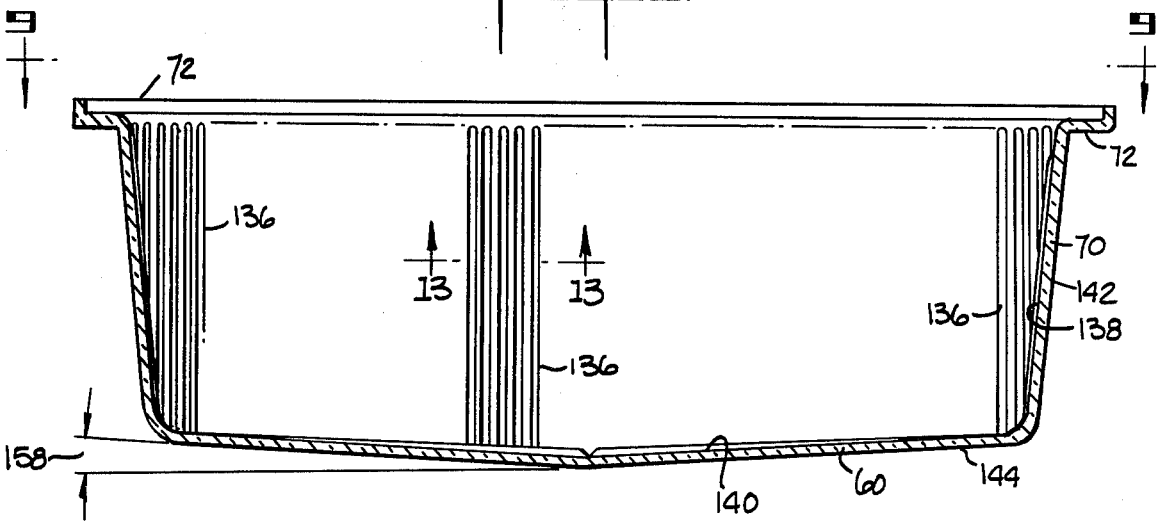
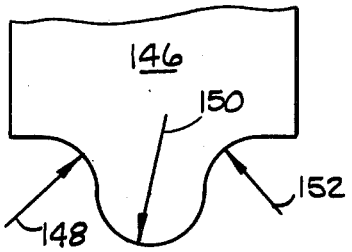
Fig. 13
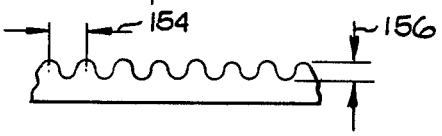
Fig. 12.
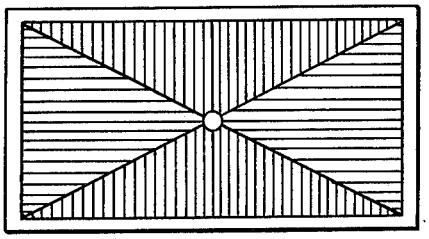
Fig. 14.
RECTANGULAR
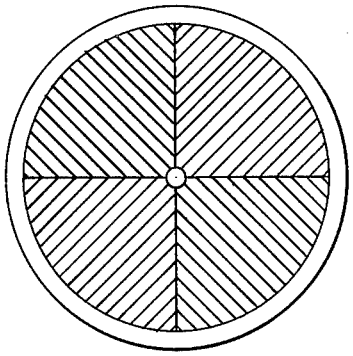
Fig. 15.
ROUND
Fig. 16.
OVAL
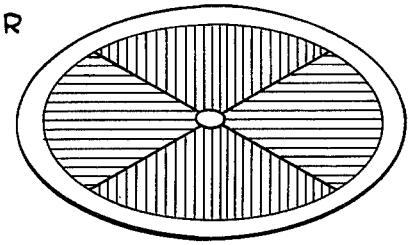

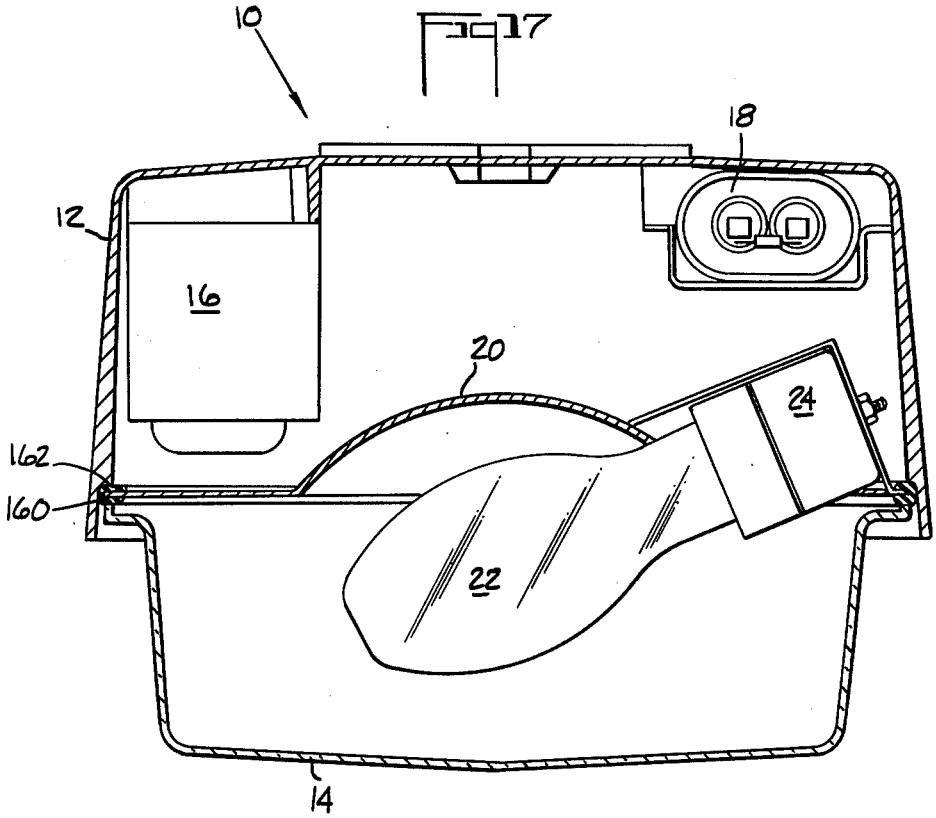
10
17
18
12
16
20
24
162
160
22
14

LUMINAIRE WITH IMPROVED LENS STRUCTURE

BACKGROUND OF THE INVENTION

This invention relates generally to luminaires and more particularly to a new and improved luminaire having an novel lens structure as described hereinafter.

It is known in the art to provide luminaires having internal reflectors and external lens structures attached to a fixture base for the purpose of directing light in a predetermined manner. Such a luminaire is shown in the Applicant's before-referenced U.S. Pat. No. 4,285,034, issued on Aug. 18, 1981 and invented by Daryl Dean Sullivan. Such prior art fixture utilizes a downwardly positioned fixture base formed around an essentially horizontal round quadrant lens and contains provisions on the internal portion of the fixture base for controlling light as desired and as more fully described in the patent. The Applicant's present invention is designed to result in a predetermined light distribution pattern which is especially useful when uniformity of illumination is desirable and sought by the purchaser of the luminaire.

One of the criteria of a good lighting installation is the uniformity of the illumination. That is, the amount of light per square unit of area should essentially remain constant throughout the area being lighted. The unit that conveys this density or the amount of light per unit area is referred to as a footcandle (fc) or as one lumen of light per square foot of the area.

In the present practice of designing lighting for indoor or outdoor areas, it is desirable to use luminaires, sometimes referred to as lighting fixtures, to provide systematic light distribution patterns. The area being lighted by prior art luminaries contains circular patches of the uniformly distributed light, that is, light of constant footcandles. These circular patches of light are bases of cones of light with apexes at the luminaires. The consequence of using these prior art type luminaires is that the criterion of uniformity of the illumination is really not met as will be more fully described hereinafter. It is not desirable to have the lack of light in the center of the layout that occurs when the patches of light are tangential to each other. It is more desirable if horizontal distances between the luminaires are decreased to add light at the center of the layout but then an excess of light will occur along the sides of the layout. Non-uniformity will still exist in spite of the additional luminaires that are needed to pull the circles of light together in a lighting layout.

SUMMARY OF THE INVENTION

With the beforementioned criteria in mind, the Applicant's luminaire accomplishes the elimination of round patches or light and obtains a predetermined distribution pattern by the luminaire thereby solving the beforementioned uniformity problem. In the preferred embodiment, the predetermined distribution pattern would be a square pattern when used in multiples as shown in FIG. 4 and it is within the spirit and scope of the invention that the predetermined distribution pattern could also be a rectangular pattern, a round pattern, an oval pattern and other patterns.

The accomplishment of a predetermined distribution pattern is obtained by adding to existing symmetric luminaires a novel light controlling lens or refractor that will give the desired pattern to be described more fully hereinafter.

In the Applicant's preferred embodiment, the luminaire would comprise in combination a fixture base for mounting on a ceiling or a side wall with a lens structure fixedly attached to the fixture base and having formed therein two lens surfaces. The first lens surface would be formed generally horizontal and would have formed thereon means for refracting a beam of light downwardly and outwardly in a predetermined pattern to form a beam having a cross section approximating the predetermined pattern at a predetermined distance below the lens. In the preferred embodiment the predetermined pattern would be a square pattern. A second generally vertical lens surface would be formed on the first lens surface and around the periphery thereof and would have formed thereon means for diffusing a beam of light outwardly. A horizontal flange would be formed on the second lens surface for mounting the lens structure on the fixture base. A reflector would be positioned within the fixture base and a lamp socket would be positioned within a portion of the reflector and would contain a lamp secured in the socket between the reflector and the lens structure. Means would also be contained within the luminaire for electrically lighting the lamp.

Accordingly, it is an object and advantage of the invention to provide a new and novel luminaire in the combination containing a novel lens structure designed to refract a beam of light downwardly and outwardly in a predetermined pattern to form a beam having a cross section approximating a predetermined pattern at a predetermined distance below the lens.

This and other objects and advantages of the invention will become apparent from a review of the drawings showing the invention and from a reading of the description of the preferred embodiment which has been given by way of illustration only.

BRIEF DESCRIPTION OF THE DRAWINGS

FIG. 1 is a perspective view of the Applicant's luminaire showing it in a square configuration;

FIGS. 2 and 3 are plan views showing lighting patterns from prior art luminaires hereinbefore described;

FIG. 4 is a plan view showing the light pattern thrown by the Applicant's preferred embodiment;

FIG. 5 is a perspective view of the Applicant's novel lens structure utilized in his luminaire of the square configuration;

FIG. 9 is an enlarged plan view of the Applicant's lens structure of the type shown in FIG. 5 and taken along line 6—6 of FIG. 5 showing in greater detail the generally horizontal first lens surface of the Applicant's design;

FIG. 10 is a partial sectional view, taken along line 10—10 of FIG. 9 showing in an enlarged detail the structure of the Applicant's first lens surface;

FIG. 11 is a sectional view, taken along line 11—11 of FIG. 9 showing in greater detail the structure of the Applicant's second lens surface of his lens structure;

FIG. 12 is a plan view of the tool utilized for constructing the side wall prisms on the inside face of the Applicant's second lens surface which would also represent the configuration of the second lens inside surface;

FIG. 13 is a sectional view, taken along line 13—13 of FIG. 11 showing in greater detail the flute structure of the Applicant's second lens surface of his lens structure;

FIGS. 14 through 16 are bottom views, taken along line 14—14 of the Applicant's luminaire showing three different variations of the lens structure with FIG. 14 showing a rectangular structure, FIG. 15 showing a round structure and FIG. 16 showing an oval structure; and FIG. 17 is a cross sectional view, taken along line 17—17 of FIG. 1 showing in greater detail the Applicant's luminaire combination and showing the placement of the various members of the combination in the luminaire.

DESCRIPTION OF THE PREFERRED EMBODIMENT

Figure 6:
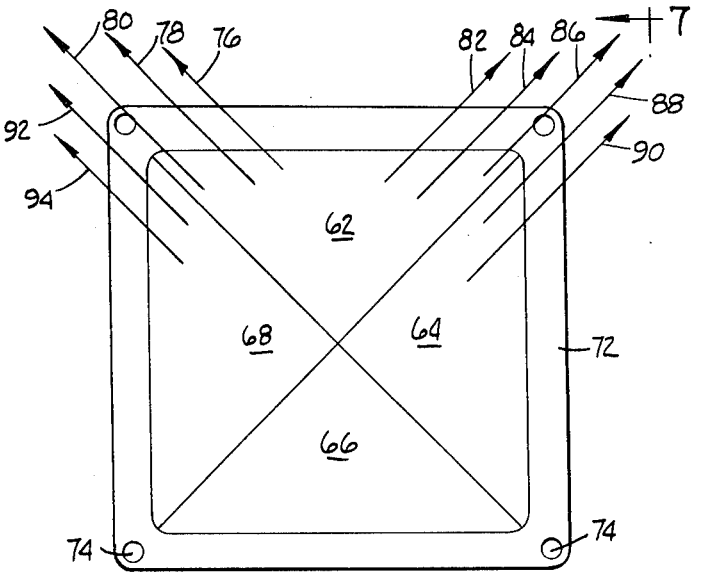
FIG. 6 is a plan view, taken along line 6—6 of FIG. 5 showing the light distribution pattern of the Applicant's preferred embodiment.

Referring now to FIG. 1 of the drawing, there is shown in detail the Applicant's new and improved luminaire shown generally by the numeral 10 which comprises a fixture base 12 and a lens structure 14. The lens structure 14 is fixedly attached to the fixture base 12 by means known in the art. The fixture base 12 contains a plurality of items shown in more detail in FIG. 17 of the drawing such as a ballast 16, and a capacitor 18 positioned within the fixture base 12. The fixture base 12 also contains a reflector 20 and a lamp 22 which is positioned within a lamp socket 24.

As has been beforementioned, in the preferred embodiment shown, the Applicant's invention has been directed to a square shaped fixture and lens structure 14 and it is within the spirit and scope of the invention that other configurations can be utilized and developed from the teachings hereinafter to be described relating to the use of a plurality of square shaped luminaires 10.

Referring now more particularly to FIGS. 2 through 4 of the drawings, there will be described in further detail the problems inherent in the prior art described fixtures and how the Applicant's solution eliminates those problems. In FIG. 2 of the drawing there is shown a plurality of prior art fixtures 26, 28, 30 and 32. The light pattern thrown by the fixtures would be similar to the circular fixture shown and would result in an area 34 shown by the cross hatched area indicating a lack of light which would not be acceptable to the user of the luminaires. By referring to FIG. 3, it can be seen that the same fixtures 26, 28, 30 and 32 have been moved closer together as shown by the center line dimensions 36 and 38 resulting in a four-leafed pattern of light shown by the numerals 40, 42, 44 and 46 which represent an excess of light. This condition would be as unattractive as the deficiency of light shown in FIG. 2 of the drawing.

Referring now to FIG. 4 of the drawing, it can be seen the Applicant's solution to this problem resulting in achieving a controlled, predetermined pattern of light shown in the preferred embodiment as a square pattern whenever the Applicant's square configured fixtures 48, 50, 52 and 54 are positioned at the predetermined positions shown by the numerals 56 and 58 in FIG. 4 of the drawing. When designed thusly, it can be seen in FIG. 4 that there are no deficiency areas of light as in FIG. 2 and no excess areas of light as in FIG. 3 thereby resulting in a more improved light pattern and heretofore possible.

In order to achieve this square light pattern as taught by the preferred embodiment, there is provided in the Applicant's luminaire 10, a lens structure 14 of the type shown in FIG. 5 of the drawing which comprises a generally horizontal first lens surface 60 having formed thereon means for refracting a beam of light from the luminaire downwardly and outwardly in a predetermined pattern to form a beam having the desired cross section approximating the predetermined pattern at predetermined distances below the lens. The generally horizontal first lens surface 60 would comprise in the preferred embodiment the lens surface 60 being divided into four triangular shaped quadrants 62, 64, 66 and 68. A generally vertical second lens surface 70 is formed on the first lens surface 60 around a periphery thereof and has formed thereon means to diffuse a beam of light outwardly. In the preferred embodiment shown, the means to diffuse the light outwardly comprises the second lens surface 70 being formed as a fluted, three surface configuration which will be described more fully hereinafter.

A generally horizontal flange 72 is formed on the second lens surface 70 and is designed for mounting the lens structure 14 within the luminaire 10 as will be described more fully hereinafter. A plurality of holes 74 are formed in the four corners of the flange 72 for this mounting purpose.

Figure 7:
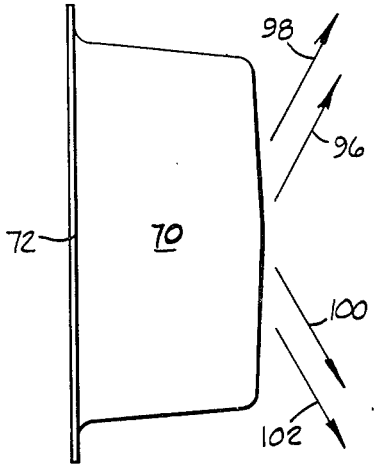
FIG. 7 is a side view, taken along line 7—7 of FIG. 6 showing the light distribution of the Applicant's preferred embodiment.

Referring now to FIGS. 6 and 7 of the drawing, there will be shown in detail the distribution pattern of the light from the lamp 22 as it is refracted through the various triangular shaped quadrants 62, 64, 66 and 68. In FIG. 6 of the drawing it can be seen, for example, that the triangular shaped quadrant prisms 62 will refract light in the direction shown by the arrows 76, 78 and 80 on one side of the triangular quadrant and also light in the direction shown by the arrows 82, 84 and 86 on the other side of the triangular shaped quadrant. In a similar manner, it can be seen that the triangular shaped quadrant 64 would refract light as shown by the arrows 88 and 90 on one side of its triangular shaped quadrant and also would refract light in the other direction similar to that of quadrant 62. In a like manner, the triangular shaped quadrant 68 would refract light as shown by the arrows 92 and 94 with all of the quadrants functioning together to provide the square distribution pattern shown in FIG. 4 of the drawing. Referring now to FIG. 7 of the drawing, there is an end view, taken along line 7—7 of FIG. 6 showing in another dimension the direction of the light refracted by the triangular shaped quadrant 62, 64, 66 and 68. These quadrants would refract light in the direction shown by the arrows 96 and 98 as well as in the direction shown by the arrows 100 and 102.

Figure 8:
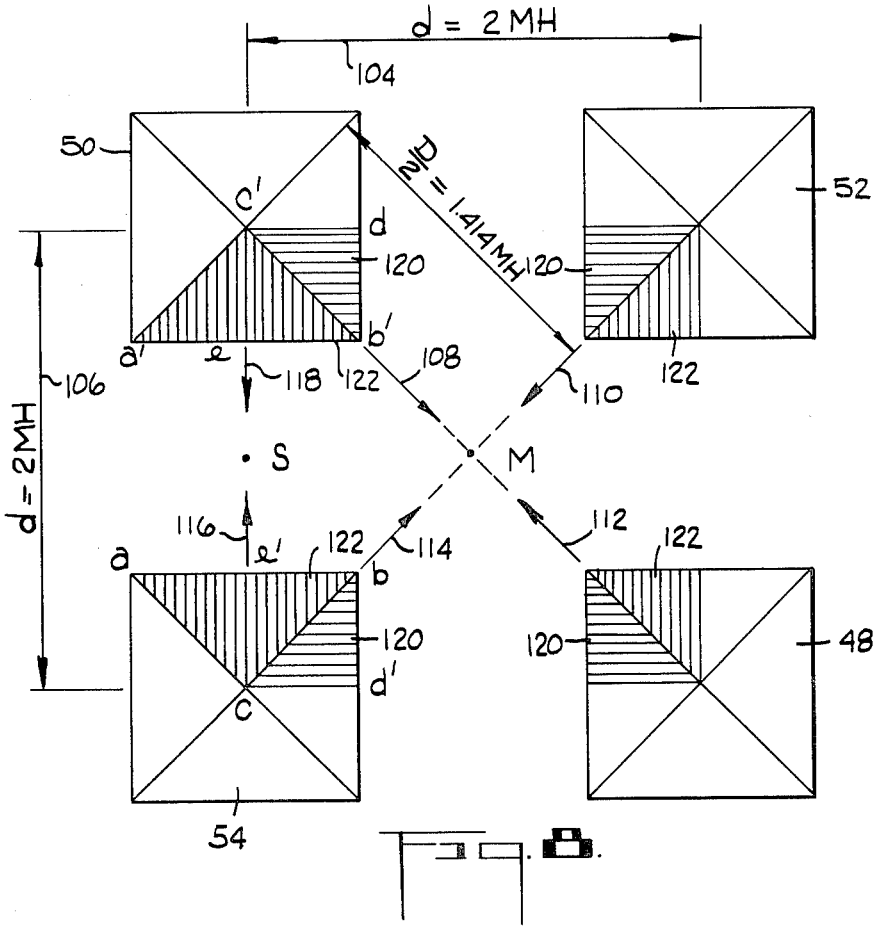
FIG. 8 is a plan view of a plurality of the Applicant's novel lens structures positioned in a predetermined pattern hereinafter described.

Referring now to FIG. 8 of the drawing, there will be described in more detail the positioning of a plurality of the Applicant's luminaires and the spacing of one luminaire from another in order to achieve a desired square light pattern as taught in the preferred embodiment. In understanding the placement of the luminaires from each other, assume that the horizontal distance between the luminaires within the rows of luminaires is two mounting heights (MH), with the mounting height being the distance between the luminaire and the work plane. The work plane may be the floor of the room or top of the desk or work bench depending where the visual task is performed. The mounting height, then, is the vertical distance between the work plane and the light emitting opening of the luminaire. In FIG. 8 the distance between luminaires is shown by the numerals 104 and 106. The luminaires would be shown by the numerals 48, 50, 52 and 54.

In order to provide an illumination (E) of one footcandle of light (fc) on the work plane at the point "S" shown in FIG. 8 half way between luminaire 50 and luminaire 54, the candlepower (CP) needed equals:

$$CP = \frac{E \times MH^2}{\cos^3 45^\circ} = 2.83$$

In order to provide one footcandle of light (fc) on the work plane at the center of the lay out, in other words at point (M), the needed candlepower equals:

$$CP = \frac{E \times MH^2}{\cos^3 54.74^\circ} = 5.2$$

Accordingly, point (M) requires about twice the candle power of the point (S) to have the same one fc of illumination. All the contributing candlepowers at the points (S) and (M) are of the same magnitude by the design. It has been found that to satisfy this requirement, twice as much of the lens area is to be assigned to send the light into the point (M) direction, as it is to the point (S) direction as shown in FIG. 8. All six beams of light shown by the numerals 108, 110, 112, 114, 116 and 118 under this consideration are of the same candlepower magnitude by the design.

In the preferred embodiment, in order to obtain a square light distribution, the prisms 120 and 122 have been employed, whereby letting half of the light emitted by the light source without altering its path but using shallow flutes in the prisms to reduce the glare of the high intensity lamps contained within the luminaire. The rest of the light intercepted by the prisms 120 and 122 of the herringbone-like paths become elevated to about 55° vertically and move horizontally due to the prisms path orientation.

Accordingly, the point "S" receives the light from the luminaire 50 and the luminaire 54 only that is from the fluted parts of the A', B', C' and A, B, C areas which adds up to one-fourth of the lens. Point "M" receives the light from luminaires 48, 50, 52 and 54 from the areas E', B, D' and C contributing an equivalent of one-eighth of the lens. Accordingly, the point "M" receives one-eighth times four equal one-half of the lens illumination which is twice as much as the point "S" needs under the previous computations.

Extending this one step further, it is worth noting that the above approach and reasoning can be extended to lighting the rectangular portions of a street instead of the present method by using oblong or oval patches of light resulting in poor uniformity of illumination. The rectangular patches will dispense with the excess of light underneath the luminaire and the lack of light between the luminaires.

In referring to FIG. 8 of the drawing, the following equations should also be noted relating to the computations hereinbefore described:

$$\frac{D/2}{2\,MH} = \sin 45^\circ$$

$$D/2 = 2\,MH \sin 45^\circ = 1.414\,MH$$

$$\frac{1.414\,MH}{1\,MH} = \tan\theta$$

$$\theta = 54.74^\circ$$

$\theta$ is the vertical angle of the four beams of light with respect to Nadir as refracted and redirected by the prisms of the herringbone-like paths.

Referring now to FIGS. 9 through 11 of the drawings, there will be shown more in detail the construction of the triangular shaped quadrants 62, 64, 66 and 68 along with the second lens surface 70 formed generally vertically around the perimeter of the triangular shaped quadrants. FIG. 10 is a cross sectional view, taken along lines 10—10 of FIG. 9 and shows in detail the profile of the prisms in the triangular shaped quadrants. Each prism element has been given a number starting at the center line 124 of the lens structure and it can be seen in FIG. 10 that the triangular shaped quadrants 62, 64, 66 and 68 are symmetrical about the center line 124 as well as the center line 126. The spacing of the prisms from the center lines 124 and 126 will be at the dimensions shown by the numeral 128 and in the preferred embodiment shown would be approximately 0.126 inches. The even number prisms 2, 4, 6, etc. would be formed at a radius shown by the numeral 130 in FIG. 10 which would be approximately 0.243 inches radius in the preferred embodiment shown. The angle of the odd number of prisms, shown by the numeral 132 in FIG. 10 would be instructed according to the following chart:

| Prism Element | Angle | Radius |
|---|---|---|
| 1 | 53.8° | |
| 2 | | .243" |
| 3 | 54.7° | |
| 4 | | .243" |
| 5 | 55.4° | |
| 6 | | .243" |
| 7 | 56.3° | |
| 8 | | .243" |
| 9 | 57.2° | |
| 10 | | .243" |
| 11 | 58° | |
| 12 | | .243" |
| 13 | 59° | |
| 14 | | .243" |
| 15 | 60° | |
| 16 | | .243" |
| 17 | 60.9° | |
| 18 | | .243" |
| 19 | 61.7° | |
| 20 | | .243" |
| 21 | 62.5° | |
| 22 | | .243" |
| 23 | 63.3° | |
| 24 | | .243" |
| 25 | 64° | |
| 26 | | .243" |
| 27 | 64.8° | |
| 28 | | .243" |
| 29 | 65.7° | |
| 30 | | .243" |
| 31 | 66.5° | |
| 32 | | .243" |
| 33 | 67.2° | |
| 34 | | .243" |
| 35 | 67.9° | |
| 36 | | .243" |

-continued

| Prism Element | Angle | Radius |
|---|---|---|
| 37 | 68.6° | |

A 1° draft would be formed on the odd number of prisms elements as shown by the numeral 134 in FIG. 10. When formed thusly, the triangular shaped quadrants 62, 64, 66 and 68 would be satisfactory for providing the square light distribution pattern shown in FIG. 4 of the drawing when the luminaires are spaced at a predetermined distance from each other as developed by the beforeindescribed equations.

Referring now to FIG. 11 of the drawing, there is shown a sectional view, taken along line 11—11 of FIG. 9 showing the second lens surface 70 of the lens structure 14 of the Applicant's invention. The second lens surface is formed generally vertical as compared to the generally horizontal first lens surface 60 and would be formed with its side flutes 136 positioned on the inside surface 138 of the second lens surface 70. In a similar manner, the beforedescribed prisms 1 through 37 would also be formed on the inside surface 140 of the first lens surface 60. Being formed in this manner, it can be seen that the outside surfaces 142 of the second lens surface 70 as well as the outside surface 144 of the first lens surface 60 can be easily cleaned and in effect can be self-cleaning due to the weather action on the smooth surface of the outside surfaces 142 and 144.

Referring now to FIG. 12 of the drawings, there is shown a plan view of a typical tool utilized for manufacturing the side wall prisms formed on the second lens surface 70. The tool 146 would be formed in a fluted three-surface configuration having a plurality of radii 148, 150 and 152. Each of these radii would be formed at approximately 0.035 inches for the configuration shown in the drawing to thereby form a fluted three-surface configuration on the second lens surface 70. By referring now to FIG. 13 of the drawing, there can be seen an enlarged section of a typical flute shown approximately double size. The spacing between the flutes of the second lens surface would be shown by the numeral 154 and would be approximately 0.125 inches in the preferred embodiment. The depth of the flutes, shown by the numeral 156 would be approximately 0.04 inches when utilizing the fluting tool shown in FIG. 12 of the drawing.

Referring now to FIGS. 14, 15 and 16, there are shown bottom views, taken along line 14—14 of FIG. 1 showing different configurations of the Applicant's basic invention with FIG. 14 showing a rectangular configuration and with FIG. 15 showing a round configuration. FIG. 16 shows an oval configuration and it is within the spirit and scope of the invention that there would be other configurations desirable utilizing the basic concepts of the invention. Should this be desired then the various prism elements in the first lens surface 60 and the second lens surface 70 would be varied accordingly to obtain the desired predetermined light pattern at predetermined distances below the lens.

In FIG. 11 of the drawings, it can be seen that the triangular shaped quadrants 62, 64, 66 and 68 of FIG. 6 may be sloped approximately 3° from the plane of the flange surface 72. This slope is shown by the numeral 158, however, it can be seen that the general configuration of the first lens surface 60 is to be positioned generally horizontal in comparison to the general slope of the second lens surface 70 which is generally vertical, all in comparison to the plane of the flange 72 as seen in FIG. 11.

Referring now to FIG. 17 of the drawing, there is shown in detail the Applicant's combination luminaire 10 showing the positioning of the lens structure 14 as it is mounted in the fixture base 12 prior to being positioned on a ceiling or a side wall. The reflector 20 is contained within a gasket 160 positioned on a ledge 162 formed on the fixture base 12. The Applicant's lens structure 14 is positioned against the gasket 160 and a plurality of screws (not shown in FIG. 17) would be positioned within the holes 74 formed on the flange 72 of the lens structure (shown in FIG. 6). The socket 24 is fixedly attached to a portion of the reflector 20 and has a lamp 22 positioned therein of the high intensity discharge type. The lamp 22 would be electrically lit by means of a ballast 16 positioned within the base fixture 12 and a capacitor 18 also positioned in the base fixture. An assortment of electrical connections connecting the various components would be utilized as is known in the art and which have been eliminated from the drawing FIG. 17 for purposes of clarity.

When formed thusly, it can be seen that the Applicant's new and novel luminaire and lens structure for the luminaire accomplishes all of the objects and advantages of the invention as hereinbefore described. Nevertheless, it should become apparent that changes may be made in the various parts of the structures and the configuration of the prisms of the lens structure without departing from the spirit and scope of the invention. The preferred embodiment has been given by way of illustration only.

I claim:

1. A lens structure for a lighting fixture, comprising:

a generally horizontal first lens surface divided into four triangular shaped quadrants, said first lens surface having formed thereon means for refracting a beam of light downwardly and outwardly in a predetermined pattern to form a beam having a cross section approximating the predetermined pattern at a predetermined distance below the lens;

said refracting means including:

prismatic refractor elements in each quadrant, the refractive elements of each quadrant extending parallel to the bisector of each triangular shaped quadrant;

light diffusing elements positioned between the prismatic refractor elements; and said first lens surface prismatic refractor elements being formed at the angle according to the following tabulation and said light diffusing elements being formed at the radius according to the following tabulation:

| Prism Element | Angle | Radius |
|---|---|---|
| 1 | 53.8° | |
| 2 | | .243" |
| 3 | 54.7° | |
| 4 | | .243" |
| 5 | 55.4° | |
| 6 | | .243" |
| 7 | 56.3° | |
| 8 | | .243" |
| 9 | 57.2° | |
| 10 | | .243" |
| 11 | 58° | |
| 12 | | .243" |
| 13 | 59° | |
| 14 | | .243" |

-continued

| Prism Element | Angle | Radius |
|---|---|---|
| 15 | 60° | |
| 16 | | .243" |
| 17 | 60.9° | |
| 18 | | .243" |
| 19 | 61.7° | |
| 20 | | .243" |
| 21 | 62.5° | |
| 22 | | .243" |
| 23 | 63.3° | |
| 24 | | .243" |
| 25 | 64° | |
| 26 | | .243" |
| 27 | 64.8° | |
| 28 | | .243" |
| 29 | 65.7° | |
| 30 | | .243" |
| 31 | 66.5° | |
| 32 | | .243" |
| 33 | 67.2° | |
| 34 | | .243" |
| 35 | 67.9° | |
| 36 | | .243" |
| 37 | 68.6° | |

a generally vertical second lens surface formed on the first lens surface and around the periphery thereof and having formed thereon means to diffuse a beam of light outwardly; and a generally horizontal flange formed on the second lens surface for mounting the lens structure in the lighting fixture.

2. The lens structure as defined in claim 1 further comprising the triangular shaped quadrants being sloped approximately 3° from the plane of the flange surface.

3. The lens structure as defined in claim 1 further comprising the refractor elements and the light diffusing elements being positioned inside the lens structure with the outside of the lens structure being formed as a generally smooth surface thereby aiding in the cleaning of the lens structure on the outside thereof.

4. The lens structure as defined in claim 1 wherein the first lens surface is formed in a generally square shape.

5. The lens structure as defined in claim 1 further comprising the first lens surface being formed in a generally rectangular shape.

6. The lens structure as defined in claim 1 further comprising the first lens surface being formed in a generally round shape.

7. The lens structure as defined in claim 1 further comprising the first lens surface being formed in a generally oval shape.

8. The lens structure as defined in claim 1 further comprising the second lens surface being formed as a three-surface fluted configuration.

* * * * *